US010096191B2

(12) United States Patent
Kodama et al.

(10) Patent No.: US 10,096,191 B2
(45) Date of Patent: Oct. 9, 2018

(54) COIN DELIVERING DEVICE

(71) Applicant: NIPPON CONLUX CO., LTD., Sakado (JP)

(72) Inventors: Yasuyuki Kodama, Sakado (JP); Nobutaka Takefuta, Sakado (JP)

(73) Assignee: NIPPON CONLUX CO., LTD., Sakado-Shi (JP)

( * ) Notice: Subject to any disclaimer, the term of this patent is extended or adjusted under 35 U.S.C. 154(b) by 0 days.

(21) Appl. No.: 15/536,395

(22) PCT Filed: Dec. 15, 2015

(86) PCT No.: PCT/JP2015/085082
§ 371 (c)(1),
(2) Date: Jun. 15, 2017

(87) PCT Pub. No.: WO2016/104254
PCT Pub. Date: Jun. 30, 2016

(65) Prior Publication Data

US 2017/0352220 A1 Dec. 7, 2017

(30) Foreign Application Priority Data

Dec. 22, 2014 (JP) ..... 2014-259338

(51) Int. Cl.
*G07D 1/02* (2006.01)
*G07D 1/00* (2006.01)

(52) U.S. Cl.
CPC ..... *G07D 1/02* (2013.01); *G07D 1/00* (2013.01)

(58) Field of Classification Search
CPC .. G07D 1/02; G07D 1/00; G07D 9/02; G07D 2201/00; G07F 5/24
(Continued)

(56) References Cited

U.S. PATENT DOCUMENTS 4,374,529 A * 2/1983 Kobayashi ..... G07D 1/00 221/11
5,697,483 A * 12/1997 Ishida ..... G07F 5/24 194/217

(Continued)

FOREIGN PATENT DOCUMENTS

JP 54127594 U1 9/1979
JP 5667577 U1 6/1981
JP 2011237990 A 11/2011

OTHER PUBLICATIONS

International Search Report issued in Intl. Appln. No. PCT/JP2015/085082 dated Jan. 26, 2016. English translation provided.

(Continued)

*Primary Examiner* — William L Miller
(74) *Attorney, Agent, or Firm* — Rossi, Kimms & McDowell LLP

(57) ABSTRACT

A first payout slide delivers a coin at a bottom in a coin tube, and a second payout slide delivers at least one coin located on the coin at the bottom in the coin tube. A selection mechanism including a change lever, solenoid, etc. performs a selection such that the first payout slide is activated alone or the first and second payout slides are activated together. A single coin is delivered through the first payout slide having been activated alone, whereas at least two coins are delivered through the first and second payout slides having been activated together. The coin delivering device may further be provided with a change slide that selectively regulates the delivery of the coin from the corresponding coin tube so that the delivery of the coin is not to be carried out regardless of an activation of the first payout slide.

10 Claims, 14 Drawing Sheets

(58) Field of Classification Search
USPC ..... 232/64, 66; 453/18, 19, 21; 194/344
See application file for complete search history.

(56) References Cited

U.S. PATENT DOCUMENTS

| | | | | |
|---|---|---|---|---|
| 6,176,773 | B1 * | 1/2001 | Mikami | G07D 1/00 453/21 |
| 6,565,427 | B2 * | 5/2003 | Kuwabara | G07D 1/00 453/21 |
| 6,896,114 | B1 * | 5/2005 | Matsumoto | G07D 1/00 194/202 |
| 9,697,665 | B2 * | 7/2017 | Hayashi | G07D 1/02 |
| 2005/0124280 | A1 * | 6/2005 | Itako | G07D 1/00 453/18 |
| 2016/0275742 | A1 * | 9/2016 | Hayashi | G07D 1/02 |
| 2017/0309102 | A1 * | 10/2017 | Kondo | G07D 1/02 |

OTHER PUBLICATIONS

Written Opinion issued in Intl. Appln. No. PCT/JP2015/085082 dated Jan. 26, 2016.

* cited by examiner

D–D (PRIOR ART)

COIN DELIVERING DEVICE

TECHNICAL FIELD

The present invention relates to a coin delivering device to be mounted in a coin processing device in a vending machine, a money changer, a fare adjustment machine, a ticket-vending machine, or a servicing apparatus (hereinafter, referred to as a "vending machine or the like") to deliver coins stored herein for each denomination in response to an amount of change or the like.

BACKGROUND ART

Conventionally, a vending machine or the like installs therein a coin processing device that discriminates whether inserted coins are genuine or not, sorts and stores, for each denomination, inserted coins that have been determined as genuine coins, and further delivers the coins that have been sorted and stored, in response to an amount of change or the like. The coin processing device comprises a coin sorting device for discriminating whether inserted coins are genuine and distributing the inserted coins into denominations, and a coin delivering device for storing, for each denomination, the inserted coins that have been distributed by the coin sorting device, selecting and delivering coins from among the stored coins in response to an amount of change or the like (e.g., Patent Literature 1).

A structure of a conventional coin delivering device will be described below with reference to FIGS. 13 and 14. FIG. 13 is a perspective view of the conventional coin delivering device. FIG. 13 shows a standby mode before delivery of coins is performed, and coin tubes 106 shown in FIG. 14 is omitted. FIG. 14 shows sectional views of a main portion of the conventional coin delivering device, a part (a) of FIG. 14 shows a state of the standby mode, a part (b) of FIG. 14 shows a state where delivering operation of coins is performed in a delivery mode, and a part (c) of FIG. 14 shows a state where delivering operation of coins is prevented in the delivery mode. It should be noted that, as shown in parts (b) and (c) of FIG. 14, the delivery mode herein refers to a state where coin-holding holes M of a payout slide 108 moves to a position out of an upper side of a coin base 107 during a reciprocation operation of the payout slide 108 as described later.

As shown in FIG. 13, the conventional coin delivering device 103 includes: a driving unit such as a motor that is not illustrated in the figure; a payout cam 110 that performs one rotation in one direction (a direction of arrow A) every one time of deliverying operation by driving force of the driving unit; a payout link 109 that includes a groove 109*a* engaging with a pin 110*a* disposed on a lower surface of the payout cam 110 so as to protrude and that reciprocates in a direction of arrow B from an initial position in the figure when the payout cam 110 performs one rotation; and a payout slide 108 that reciprocates in the direction of arrow B in response to a reciprocating motion of the payout link 109. Further, a plurality of coin-holding holes M are formed in the payout slide 108 in correspondence relation to a plurality of coin tubes 106 (namely, a coin storage section), and each of the coin-holding holes M is adapted to hold the periphery of each coin stored at each of lowest surfaces of the plurality of coin tubes 106. Further, a coin base 107 is disposed below the payout slides 108 so as to support bottoms of stored coins in the standby mode as shown in FIG. 14(*a*).

Meanwhile, in correspondence relation to the kinds of the plurality of coin tubes 106, a plurality of change slides 111 are inserted into the payout link 109 so as to be freely pulled out therefrom and inserted therein. Each distal end of the change slides 111 positions below each of the coin holdng holes M of the payout slides 108 so that the change slides 111 perform to switch between delivery and non-delivery of coins each contained in each of the coin holdng holes M. While the change slides 111 operate and move in response to motion of the payout link 109, the change slides 111 do not respond to the payout link 109 when movements of the change slides 111 are regulated.

Each of change levers 112 that moves in an upper and lower direction by the driving unit is disposed at a rear portion of each of the change slides 111. The change lever 112 is attached to a distal end of a plunger of a solenoid 113 for a corresponding one of change levers 112. The plunger of the solenoid 113 is energized by a return spring in a protruding direction. The plunger is retracted in a direction opposite to the protruding direction by energization to the solenoid 113, and returns back to an original position by biasing force of the return spring when the energization to the solenoid 113 halts. Therefore, when the energization to the solenoid 113 has halted, the change lever 112 has a downward delivery preventing position due to biasing force of the return spring and engages with a rear end of the change slide 111 so as to regulate a movement of the change slide 111. When the energization to the solenoid 113 is carried out, the change lever 112 moves upward and takes a delivery allowable position. As a result, the engagement with the rear end of the change slide 111 is released and the movement of the change slide 111 is not regulated. A mechanism including the change slide 111, the change lever 112 and the solenoid 113 is provided in correspondence relation to each of the coin-holding holes M one-to-one, and each mechanism individually operates.

In a state where the rear end of the change slide 111 does not abut against the change lever 112 corresponding thereto, as illustrated in FIG. 14(*b*), the change slide 111 reciprocates in response to the reciprocations of the payout link 109 and the payout slide 108 to open a lower portion of the corresponding coin-holding hole M. On the other hand, in a state where the rear end of the change slide 111 abuts against the change lever 112 corresponding thereto, as illustrated in FIG. 14(*c*), the change slide 111 does not reciprocate in response to the reciprocations of the payout link 109 and the payout slide 108 to maintain the position in the satndby mode (see FIG. 14(*a*)).

With this arrangement, the conventional coin delivering device 103 operates as follows. First, operation of the change lever 112 and the change slide 111 will be described here. Energization is performed to only one of the solenoids 113 corresponding to one of coin-holding holes M for a coin to be delivered so as to move a corresponding one of change levers 112 upward (switching operation). Therefore, abutment of the change slide 111 against the change lever 112 is released so that the change slide 111 corresponding to the coin-holding hole M for the coin to be delivered can reciprocate in response to a reciprocation of the payout slide 108. On the other hand, the remaining solenoids 113 corresponding to the remaining coin-holding holes M for coins not to be delivered are not energized. Thus, abutment of the remaining change slides 111 against the remaining change levers 112 are not released so that movement of the remaining change slides 111 corresponding to the remaining coin-holding holes M for coins not to be delivered are regulated.

Next, operation of the payout link 109 and the payout slide 108 will be described here. Once a payout cam 110 performs one rotation in the direction of arrow A by a drive of the driving unit such as a motor not illustrated, then the payout link 109 and the payout slide 108 reciprocate in the direction of arrow B. Here, individual coins contained in the respective coin-holding holes M of the payout slide 108 also slide along with the payout slide 108.

In a case where a coin should be delivered at that time, as shown in FIG. 14(*b*), the change lever 112 corresponding to the coin to be delivered has moved to a position where the change slide 111 does not abut against the change lever 112. Thus, because the change slide 111 slidly moves backward in response to the movement of the payout link 109 and the payout slide 108, the lower portion of the coin-holding hole M is to be opened. In this case, a coin having been held in the coin-holding hole M is lost a lower support, then falls down and is delivered accordingly. On the other hand, in a case where a coin should not be delivered, as shown in FIG. 14(*c*), the change lever 112 corresponding to the coin not to be delivered has moved to a position where the change slide 111 abuts against the change lever 112. Thus, because the change slide 111 does not move in response to the movement of the payout link 109 and the payout slide 108, the lower portion of the coin-holding hole M is to be supported by the change slide 111. In this case, because a coin having been held in the coin-holding hole M is still supported by the change slide 111, the coin does not fall down and is not delivered accordingly.

With such an arrangement as the aforementioned coin delivering device having the plurality of coin tubes 106 and the payout slide 108 therebelow which has the coin-holding holes M for a plurality of denominations, it is possible, in principle, to deliver coins of the plurality of denominations by a single reciprocation of the payout slide 108 simultaneously. Namely, in the example of FIG. 13, five coin-holding holes M are provided in the payout slide 108 and a total of five coin tubes 106 are provided in corressponding relation to the coin-holding holes M. Thus, in order to selectively deliver a coin or coins from the plurality of coin tubes 106, it is configured so that, while the payout slide 108 is driven by single drive means (namely, drive means associated with the payout cam 110) commonly, the change slides 111 which are individually provided in association with the coin tubes 106 are controlled by the change levers 112 respectively to thereby select one or more coin tubes 106 (namely, denominations) to be used for delivering the coin or coins. It should be noted that there is a known coin delivering device which is configured to mechanically support a delivery operation in order to supplement a shortage of electrical power. Thus, this realizes to deliver more denominations of coins simultaneously.

Normally, a thickness of the coin-holding hole M formed in the payout slide 108 is to be equivalent to a thickness of one coin for each denomination. In such a case, it is merely possible to deliver one coin for each denomination. In view of this point, it is known such a coin delivering device which has a payout slide 108 having a coin-holding hole M with a thickness equivalent to a thickness of two coins of a desired denomination (coin tube 106) to thereby enable to deliver two coins of the desired denomination simultaneously.

However, such an arrangement that the thickness of the coin-holding hole M corresponding to the desired denomination (coin tube 106) is equivalent to the thickness of two coins of the desired denomination becomes a device dedicated to deliver two coins, which performs to merely select as to whether two coins should be delivered or not. For this reason, in order to be able to select in such a manner that any one of one and two coins for a desired denomination should be delivered at a time, it is necessary for such a known coin delivering device to provide with separate coin tubes 106, for the desired denomination, dedicated to one-coin delivery and double-coin-delivery respectively.

PRIOR ART LITERATURE

Patent Literature

Patent Literature 1: Japanese Patent Application Laid-open Publication No. 2011-237990

SUMMARY OF INVENTION

In view of the foregoing, it is an object of the present invention to provide a coin delivering device capable of selecting the number of coins to be delivered at a time from a single coin storage section (coin tube).

In order to accomplish the above-mentioned object, the present invention provides a coin delivering device which comprises: a coin storage section (6) configured to store coins and having a slit (S) for delivering a coin at a lower end of the coin storage section; a first delivering slide member (8A) for delivering a coin located at a bottom in the coin storage section; a second delivering slide member (8B) for delivering at least one coin located on the coin at the bottom in the coin storage section; and a selection mechanism (12, 13) that performs a selection such that the first delivering slide member (8A) is activated alone or the first and second delivering slide members (8A, 8B) are activated together, wherein a single coin is delivered through the first delivering slide member (8A) having been activated alone, whereas at least two coins are delivered through the first and second delivering slide members (8A, 8B) having been activated together. It should be noted that the reference numerics parenthesized above and below respectively show reference numerics of corresponding components in embodiments described later as an example of the components of the present invention.

In this way, because the first and second delivering slide members (8A, 8B) are arranged in a verticaly-overlapped way and it is capable of the selection such that the first delivering slide member (8A) is activated alone or the first and second delivering slide members (8A, 8B) are activated together, it is accomplished to select which of a single coin and at least two coins should be delivered at a time from the single coin storage section.

In an embodiment, the selection mechanism may include a regulation operation member (12, 13) that is selectively displacable, wherein the regulation operation member may be positioned at a first position to regulate a movement of the second delivering slide member (8B) when the single coin should be delivered, and the regulation operation member may be positioned at a second position not to regulate the movement of the second delivering slide member (8B) when the at least two coins should be delivered. Further, the coin delivering device may comprises a drive device (9, 10) that drives the first delivering slide member (8A) in order to deliver a coin; and a first coupling section (8A1, 8B1) that couples the second delivering slide member (8B) to the first delivering slide member (8A). In this way, with the first delivering slide member (8A) only driven by the drive device (9, 10), it is capable of selectively driving the second delivering slide member (8B) too in response to the position of the regulation operation member (12, 13) following the first delivering slide member, so that the first and second delivering slide members (8A, 8B) can be driven effectively.

In an embodiment, the coin delivering device may further comprise a first delivery regulation member (11A) disposed adjacently to the first delivering slide member (8A) in a direction of a movement for delivering a coin and configured to regulate a delivery of a coin through the first delivering slide member; and a second delivery regulation member (11B) disposed adjacently to the second delivering slide member (8B) in a direction of a movement for delivering a coin and configured to regulate a delivery of a coin through the second delivering slide member (8B). At the first position, the regulation operation member (12, 13) regulates a movement of the second delivery regulation member without regulating a movement of the first delivery regulation member so that the second delivering slide member is deactivated, on the other hand, at the second position, the regulation operation member does not regulate the movements of the first and second delivery regulation members so that both of the first and second delivering slide members are activated. Further, the regulation operation member may be configured to be positioned at a third position to regulate the both movements of the first and second delivery regulation members when no coin should be delivered. Further, the coin delivering device may comprise a second coupling section (9*c*1, 11A1, 9*d*1, 11B1) that couples the first and second delivery regulation members (11A, 11B) to the drive device (9, 10) respectively. When the movement of the first and/or second delivery regulation members (11A, 11B) is regulated in response to the position of the regulation operation member (12, 13), the coupling of the first and/or second delivery regulation members through the second coupling section (9*c*1, 11A1, 9*d*1, 11B1) is cancelled in accordance with driving of the drive device (9, 10) so that the first and/or second delivering slide members is deactivated. In this way, it becomes to be able to drive the first and second delivering slide members (8A, 8B) too by the drive device (9, 10), so that the first and second delivering slide members (8A, 8B) can be driven effectively.

A movement preventing member (15) may be provided in order to control a position of the regulation operation member (12). When the single coin (C) is delivered, the movement preventing member (15) may be operated prior to an operation of the regulation operation member (12) so that an upward movement of the regulation operation member (12) is prevented, and, when the at least two coins (C) are delivered, the movement preventing member (15) may be operated after an operation of the regulation operation member (12) so that an downward movement of the regulation operation member (12) is prevented. In this way, the position of the regulation operation member (12) can be defined step-by-step by only determining which of the regulation operation member (12) and the movement preventing member (15) should be operated prior to another one.

Further, in the coin delivering device (3), when an operation of the delivery of a coin is carried out, the first delivery regulation member (11A) may support an underside of the coin so that the delivery of the coin (C1) through the first delivering slide member (8A) is regulated, and when an operation of the delivery of a coin is carried out, the second delivery regulation member (11B) may regulate the movement of the second delivering slide member (8B) so that the delivery of the coin (C2) through the second delivering slide member (8B) is regulated. Because a way of regulating the delivery of the coin (C1) at the bottom through the first delivery regulation member (11A) is differentiated from a way of regulating the delivery of the at least one coin (C2) on the coin at the bottom through the second delivery regulation member (11B) in such a manner that only the first delivery regulation member (11A) supports the underside of the coin and the second delivery regulation member (11B) only regulates the movement of the second delivering slide member (8B), the ways of regulating are simplified, and there is no need of space between the first delivery regulation member (11A) and the second delivery regulation member (11B) or between the first delivering slide member (8A) and the second delivering slide member (8B). Thus, the coin delivering device can be constructed compactly.

BRIEF DESCRIPTION OF DRAWINGS

FIG.6A is a perspective view of a selectively-delivering section, and FIG. 6B is a sectional view along A-A line in FIG. 4.

FIG.8A is a view in the standby mode, and FIG. 8B is a view in a non-delivery state.

FIG. 9A is a view in a single-coin-delivery state, and FIG. 9B is a view in a double-coin-delivery state.

FIG. 10A is a perspective view of the selectively-delivering section, and FIG. 10B is a sectional view along B-B line in FIG. 8B.

FIG. 11A is a perspective view of the selectively-delivering section, and FIG.11B is a sectional view along C-C line in FIG. 9A.

FIG. 12A is a perspective view of the selectively-delivering section, and FIG. 12B is a sectional view along D-D line in FIG. 9B.

FIG. 14A is a view in a standby mode, FIG. 14B is a view in a state where delivering operation of coins is performed in a delivery mode, and FIG. 14C is a view in a state where delivering operation of coins is prevented in the delivery mode.

EMBODIMENTS OF INVENTION

Figure 1:
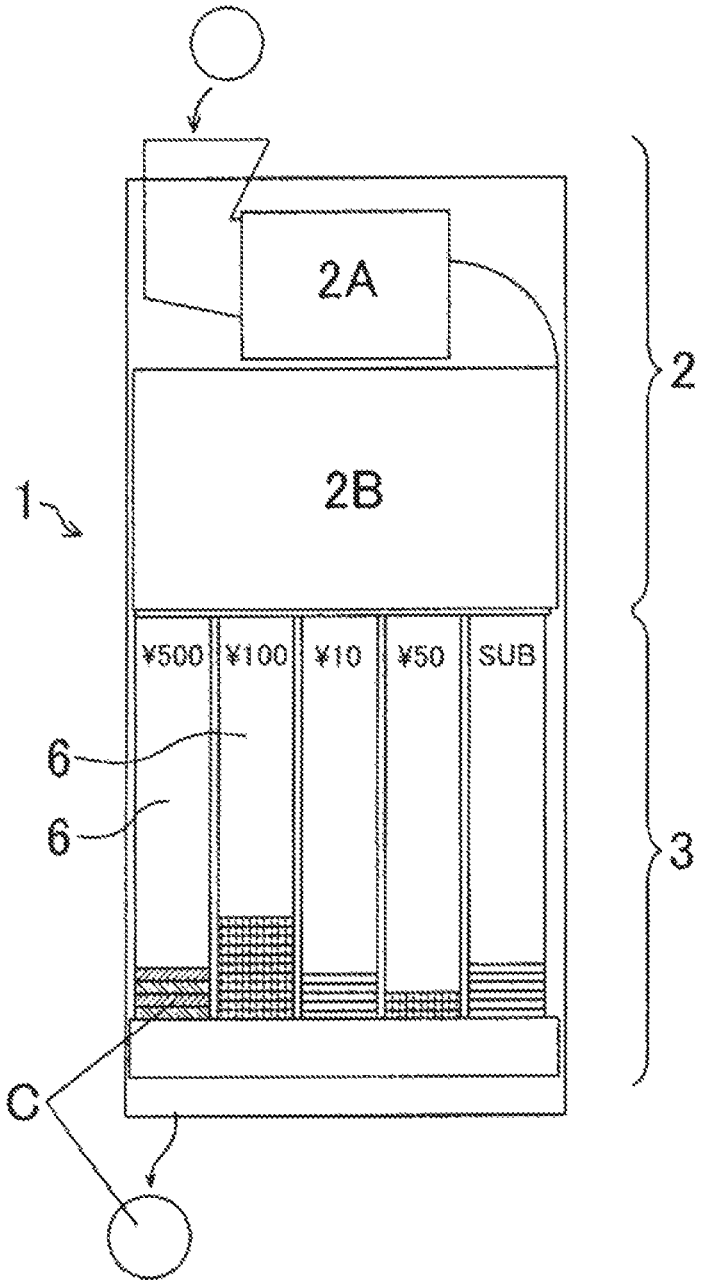
FIG. 1 is a schematic view of a coin processing device having a coin delivering device.

The embodiments of the present invention will be described hereinbelow with reference to the accompanying drawings. FIG. 1 is a schematic view of a coin processing device having a coin delivering device. As shown in FIG. 1, a vending machine or the like installs therein a coin processing device 1 that stores and delivers coins. The coin processing device 1 comprises a coin sorting device 2 and a coin delivering device 3. The coin sorting device 2 includes a coin discriminating unit 2A for discriminating whether inserted coins are genuine or not, and a coin distributing unit 2B for distributing the coins determined as genuine coins into deniminations. Further, the coin delivering device 3 selects and delivers one or more coins C from the coins stored for each denomination in response to an amount of change. The coin delivering device 3 includes coin tubes 6 (i.e., a coin storage section) different from each other by denomination.

Because five coin tubes 6 are provided in the coin delivering device 3 according to the presently-described embodiment, the coin delivering device 3 can address five denominations of coins. In the construction disclosed exemplarily in the present embodiment, a selectively-delivering section X capable of selectively delivering a single coin or at least two coins at a time according to the present invention is provided in association with only one (i.e., the most foreside one in FIG. 2) of the coin tubes 6. Delivering sections (i.e., four delivering sections located at backside in FIG. 2) associated with respective remaining four tubes of the coin tubes 6 are configured to be capable of delivering only a single coin at a time.

Figure 2:
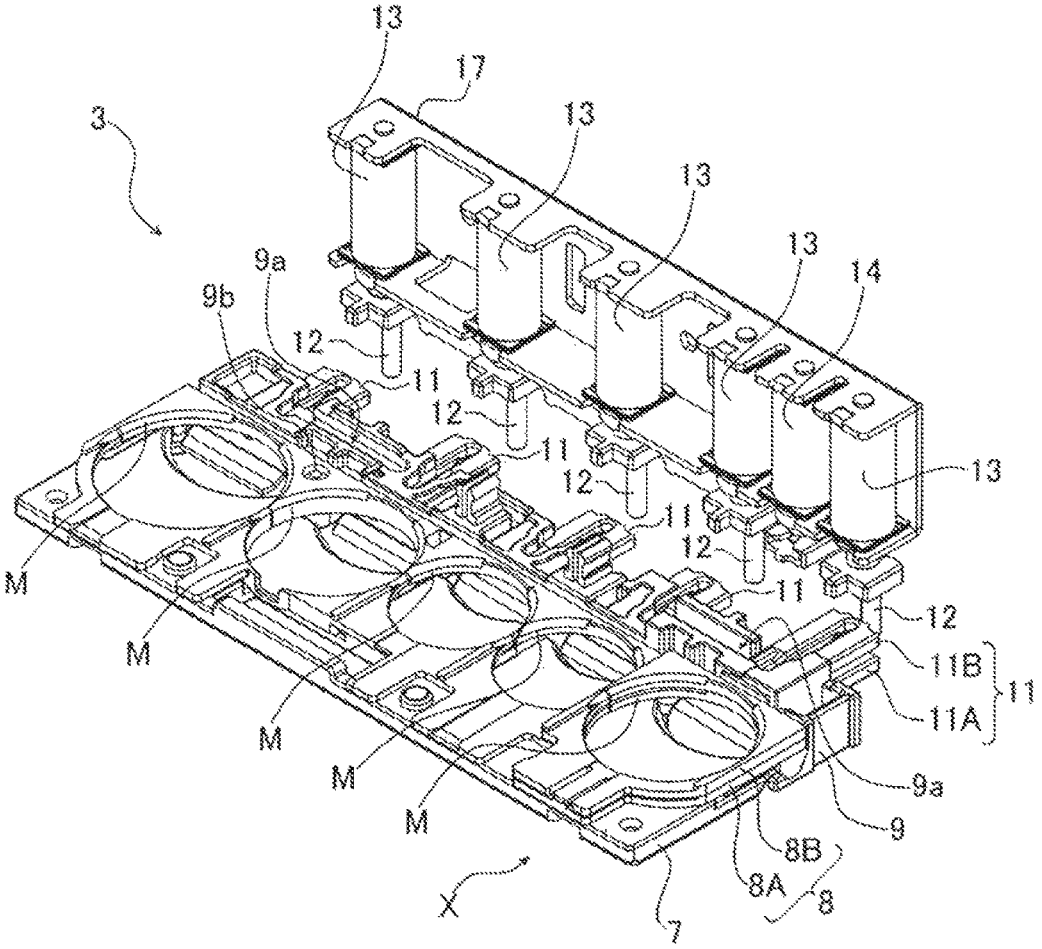
FIG. 2 is a perspective view of the coin delivering device.
Figure 3:
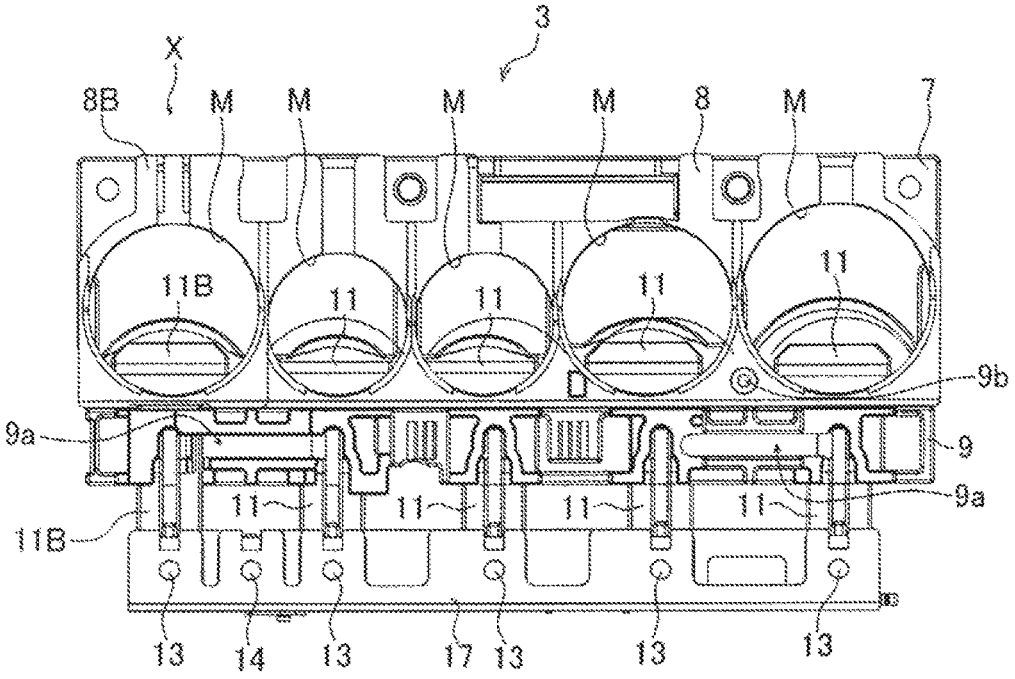
FIG. 3 is a plan view of the coin delivering device.
Figure 4:
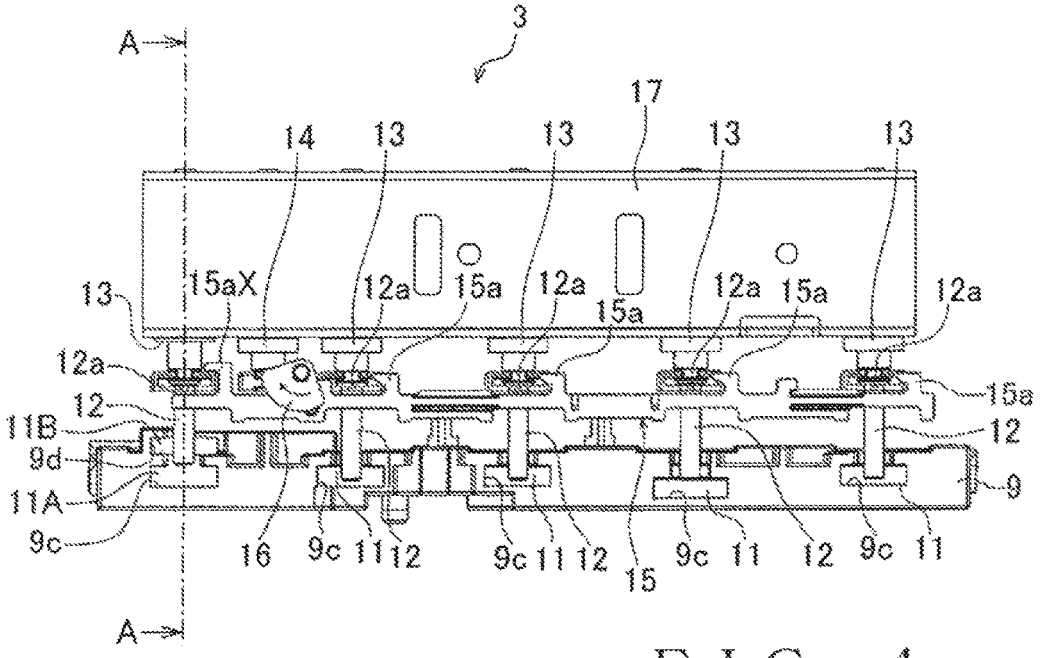
FIG. 4 is a back view of the coin delivering device.
Figure 5:
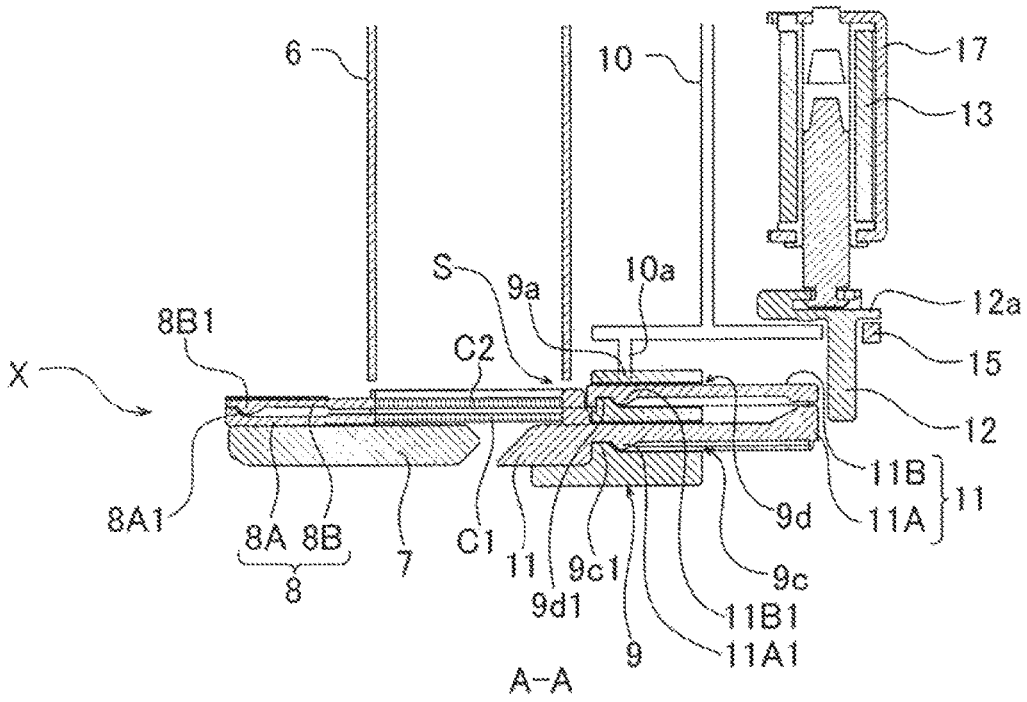
FIG. 5 is a sectional view along A-A line in FIG. 4.
Figure 13:
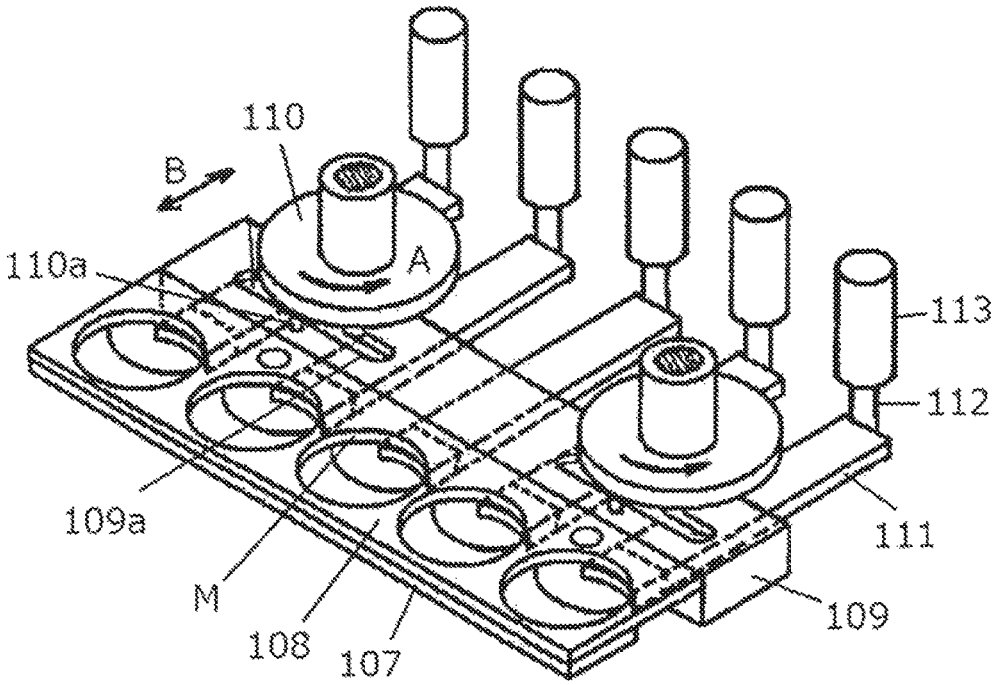
(PRIOR ART) F I G. 1 3
FIG. 13 is a perspective view of a conventional coin delivering device.
Figure 14A:
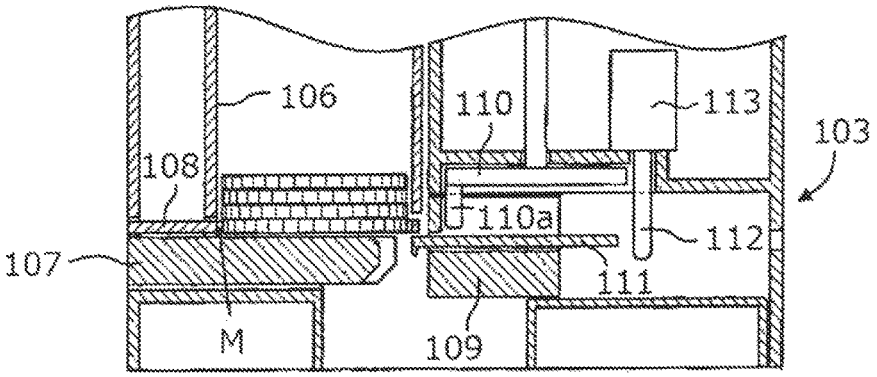
FIGS. 14A, 14B, and 14C show sectional views of a main portion of the conventional coin delivering device.
Figure 14B:
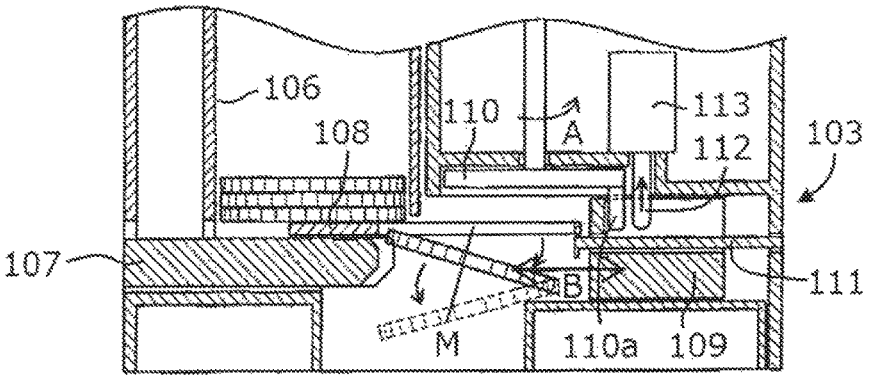
(PRIOR ART) FIG. 14B
Figure 14C:
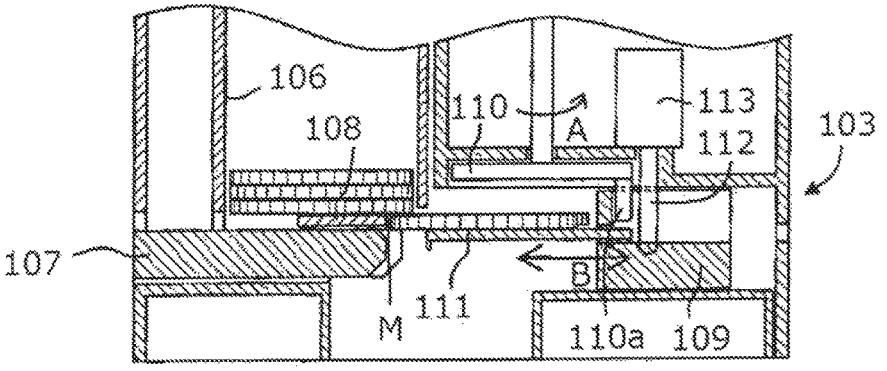
(PRIOR ART) FIG. 14C

Next, the general description of the coin delivering device 3 of the present embodiment will be made hereinafter with reference to FIGS. 2 to 5. FIG. 2 is a perspective view of the coin delivering device 3, FIG. 3 is a plan view of the coin delivering device 3, FIG. 4 is a back view of the coin delivering device 3, and FIG. 5 is a sectional view along A-A line in FIG. 4. In order to illustrate a main construction, coin tubes 6 for storing coins C and a payout cam 10 for operating a payout link 9 have been omitted in FIGS. 2 to 4. As shown in FIG. 5, each of the coin tubes 6 storing with coins stacked therein is provided with a slit S, at a bottom thereof, for allowing a payout slide 8 for delivering coins to pass through. Note that an operation of the payout cam 10 is similar to the aforementioned conventional payout cam 110 (see FIG. 13).

As shown in FIGS. 2 to 5, in addition to the coin tubes 6 and the payout cam 10, the coin delivering device 3 comprises: a coin base 7 (i.e., a coin support section) provided under the coin tubes 6 to support the coins stored in the coin tubes 6; the payout slide 8 (that includes a first payout slide 8A and a second payout slide 8B) having coin-holding holes M each corresponding to a peripheral shape and thickness of a coin stored in the corresponding one of the coin tubes 6, the payout slide 8 being a delivering slide member for delivering coins stored in the coin tubes 6 through the slit S; a payout link 9 engaged with the payout slide 8 to pull out the payout slide 8 in a direction of a movement for delivering a coin when the coin should be delivered; change slides 11 (that include a first change slide 11A and a second change slide 11B) disposed adjacently to the payout slide 8 in the direction of the movement for delivering the coin, the change slides 11 being a delivery regulation member for regulating a delivery of a coin through the payout slide 8; and change levers 12 (i.e., a regulation operation member) each capable of operating a movement of the corresponding change slide 11 by abutting against the change slide 11. Here, the payout link 9 engages with the payout cam 10 through an engaging groove 9*a* and engages with the payout slide 8 (particularly, a slide plate provided with the lower first payout slide 8A) through a projection 9*b* for engagement (see FIGS. 2 and 3). Further, the change slide 11 is slidably inserted in a slide hole 9*c* formed in the payout link 9 (see FIG. 4). The payout link 9, the payout cam 10, a not-shown motor for driving the payout cam, etc. function as a drive device.

Each of the change levers 12 moves by energization to a corresponding one of solenoids 13. Each of the change levers 12 is attached to a distal end of a plunger of the solenoid 13 for the change lever 12. The plunger of the solenoid 13 is energized by a return spring in a protruding direction. The plunger is retracted in a direction opposite to the protruding direction by energization to the solenoid 13, and returns back to an original position by biasing force of the return spring when the energization to the solenoid 13 halts. When the energization to the solenoid 13 has halted, the change lever 12 takes a downward delivery preventing position due to biasing force of the return spring and engages with a rear end of the change slide 11 so as to regulate the movement of the change slide 11. When the energization to the solenoid 13 is carried out, the change lever 12 moves upward and takes a delivery allowable position. As a result, the engagement with the rear end of the change slide 11 is released and the movement of the change slide 11 is not regulated. A mechanism including the change slide 11, the change lever 12 and the solenoid 13 is provided in correspondence relation to each of the coin-holding holes M one-to-one, and each mechanism individually operates. The solenoid 13 for the change lever 12 is contained in a solenoid case along with a solenoid 14 for a keeping lever 15 that will be described later.

The keeping lever 15 is provided on a rear side of the coin delivering device 3 and configured to mechanically prevent an action of each change lever 12 so as to maintain a state of the change lever 12. Particularly, as shown in FIG. 4, on the rear side of the coin delivering device 3, there are provided the keeping lever 15, a link member 16 that engages with the keeping lever 15 to operate the keeping lever 15, and the solenoid 14 for the keeping lever that drives the link member 16 to operate the keeping lever 15. The keeping lever 15 includes a plurality of comb-tooth-shaped preventing segments 15*a* including a preventing segment 15*a*X that is a featuring part of the present embodiment, and each preventing segment 15*a* is engageable with a keeping projection 12*a* formed on the corresponding change lever 12 to prevent a movement of the keeping projection 12*a*. It should be noted that the preventing segment 15*a*X of the keeping lever 15 in the selectively-delivering section X is configured in such a manner that an upper end of the preventing segment 15*a*X is located at a position higher than other preventing segments 15*a* and that a lower portion of the preventing segment 15*a*X is formed flat as well as an upper portion thereof.

With this arrangement, once the solenoid 14 for the keeping lever is energized, the link member 16 rotates in a direction of an arrow to move the keeping lever 15 engaged with the link member 16 in a left direction in FIG. 4. Once the keeping lever 15 moves left in FIG. 4, each of the preventing segments 15*a* of the keeping lever 15 is positioned at an upper or lower side of the corresponding keeping projection 12*a* so that upward and downward movements of the keeping projection 12*a* are regulated. As a result, the keeping lever 15 mechanically prevents upward and downward movements of the change lever 12 or keeps the change lever 12 from moving.

According to the aforementioned arrangement, in a state where the coin delivering device 3 is operated, first, a height of the change lever 12 is adjusted by operating the solenoid 13 for the change lever and the solenoid 14 for the keeping lever in such a manner as described later. Next, on rotating the payout cam 10, the payout link 9 engaged with the payout cam 10 through the engaging groove 9*a* moves backward (in a direction of the change lever 12) while pulling out the payout slide 8 (particularly, the slide plate provided with the first payout slide 8A). At this moment, in case where a backward movement of the change slide 11 is regulated by the change lever 12, the change slide 11 remains at an initial position to thereby prevent the coin held in the coin-holding hole M of the payout slide 8 from falling. On the other hand, in case where the backward movement of the change slide 11 is not regulated by the change lever 12, because the change slide 11 moves backward from the initial position, the change slide 11 does not prevent the coin held in the coin-holding hole M of the payout slide 8 from falling so that the coin falls down from the coin-holding hole M to be delivered.

Figure 6A:
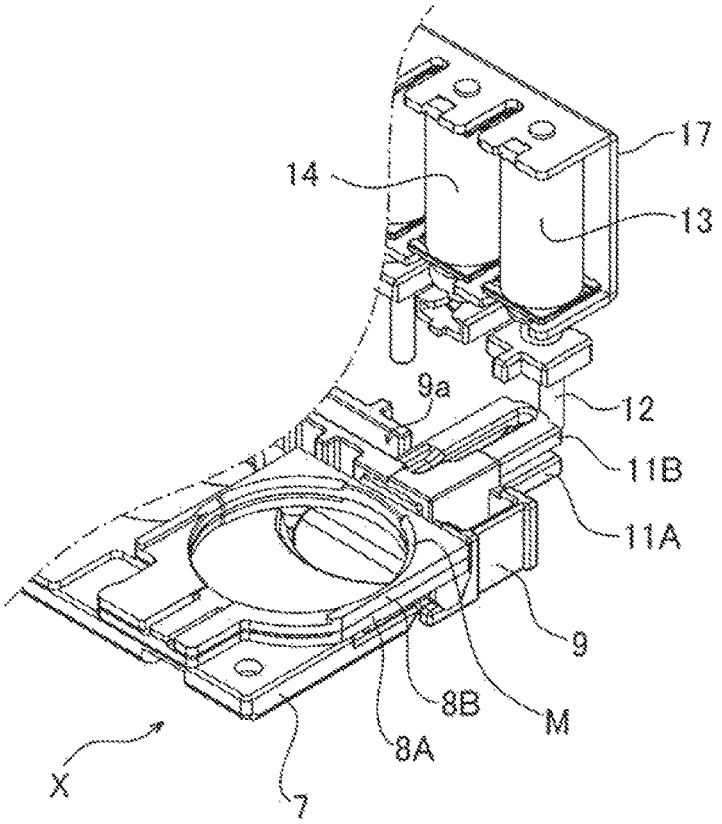
FIGS. 6A and 6B show diagrams of the coin delivering device in a standby mode.
Figure 6B:
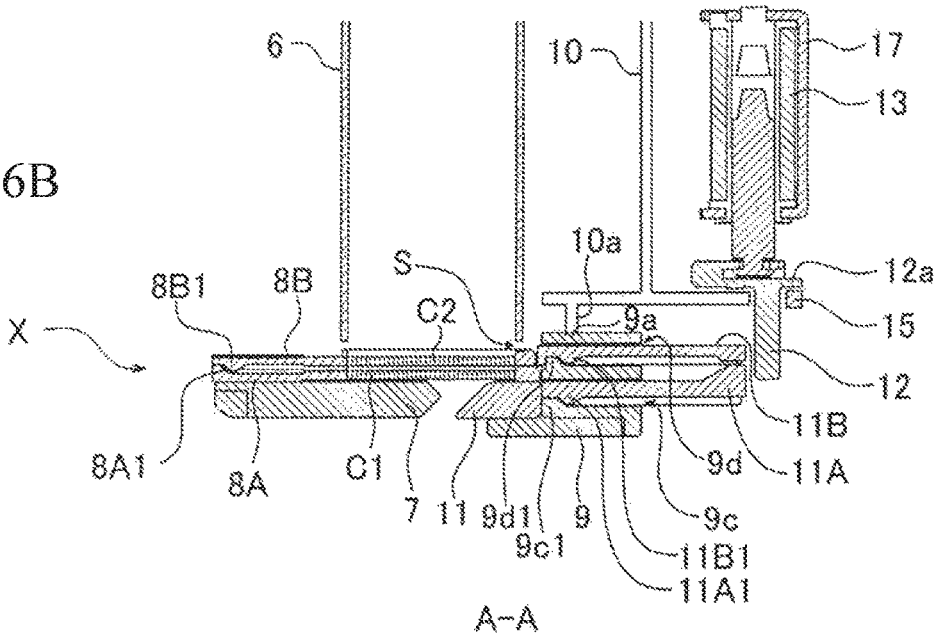

Next, the selectively-delivering section X, i.e., a featuring part of the present embodiment, capable of selectively delivering a plurality of coins will be described in detail. The selectively-delivering section X can perform, by selectively switching, one of a plurality of modes for coin delivery, such as a non-delivery state where no coin is delivered, a single-coin-delivery state where only a single coin is delivered, a double-coin-delivery state where two coins are delivered at a time, etc. First, a detailed construction of the selectively-delivering section X will be described with reference to FIG. 6. FIG. 6 shows diagrams of the coin delivering device in a standby mode, a part (a) is a perspective view of the selectively-delivering section, and a part (b) is a sectional view along A-A line in FIG. 4. Note that FIG. 6(*b*) shows a schematic construction of the coin tubes 6 and the payout cam 10 which is omitted in FIG. 4. The payout cam 10 engages with the engaging groove 9*a* of the payout link 9 through a pin 10*a* provided protrudedly on a lower surface of the payout cam 10.

The payout slide 8 in the selectively-delivering section X includes the first payout slide 8A for delivering a coin C1 located at a bottom in the coin tube 6 and the second payout slide 8B for delivering a coin C2 located immediately upon the coin C1 at the bottom in the coin tube 6. Note that the first payout slide 8A is provided in the slide plate common to all coin tubes 6. Namely, the coin-holding holes M of the respective denominations corresponding to the respective coin tubes 6 are provided in the single slide plate common to all coin tubes 6, and a portion forming a single coin-holding hole M of the denomination corresponding to the coin tube 6 related to the selectively-delivering section X functions as the first payout slide 8A. The second payout slide 8B is provided in only the selectively-delivering section X, and a coin-holding hole M of the denomination corresponding to the coin tube 6 related to the selectively-delivering section X is provided with a thickness deliverable a single coin of the denomination. It should be noted that, in a modification as described later, the thickness of the second payout slide 8B is not limited to a size for single-coin-delivery, but can be constructed in such a size as to deliver two or more coins C2 at a time. The first payout slide 8A functions as a first delivering slide member for delivering the coin C1 located at the bottom in the coin tube 6 (the coin storage section), and the second payout slide 8B functions as a second delivering slide member for delivering at least one coin C2 located on the coin C1 at the bottom in the coin tube 6 (the coin storage section).

A coupling projection 8A1 is formed upward at a front end of the first payout slide 8A, and a coupling projection 8B1 is formed downward at a front end of the second payout slide 8B. In this way, the first and second payout slides 8A, 8B are coupled with each other at the front ends thereof (loosely engaged with each other). These coupling projections 8A1, 8B1 function as a first coupling section that couples the second payout slide 8B (the second delivering slide member) to the first payout slide 8A (the first delivering slide member). When the movement of the second payout slide 8B (the second delivering slide member) is not regulated, the second payout slide 8B (the second delivering slide member) moves along with the first payout slide 8A (the first delivering slide member) through the coupling projections 8A1, 8B1 (the first coupling section) as the first payout slide 8A (the first delivering slide member) is driven by the payout link 9 and the payout cam 10 (namely, the drive device). On the other hand, when the movement of the second payout slide 8B (the second delivering slide member) is regulated, the coupling of the second payout slide 8B (the second delivering slide member) to the first payout slide 8A (the first delivering slide member) through the coupling projections 8A1, 8B1 (the first coupling section) is cancelled as the first payout slide 8A (the first delivering slide member) is dirven by the payout link 9 and the payout cam 10 (namely, the drive device) so that the second payout slide 8B (the second delivering slide member) is deactivated.

The change slide 11 in the selectively-delivering section X comprises a first change slide 11A that is disposed adjacently to the first payout slide 8A in a direction of a movement for delivering a coin and configured to regulate the delivery of the coin C1 through the first payout slide 8A, and a second change slide 11B that is disposed adjacently to the second payout slide 8B in a direction of a movement for delivering a coin and configured to regulate the delivery of the coin C2 through the second payout slide 8B. The first change slide 11A is provided slidably through the slide hole 9*c* provided in the payout link 9, and the second change slide 11B is provided slidably through a slide hole 9*d* provided in the payout link 9 at an upside of the slide hole 9*c*.

Figure 7:
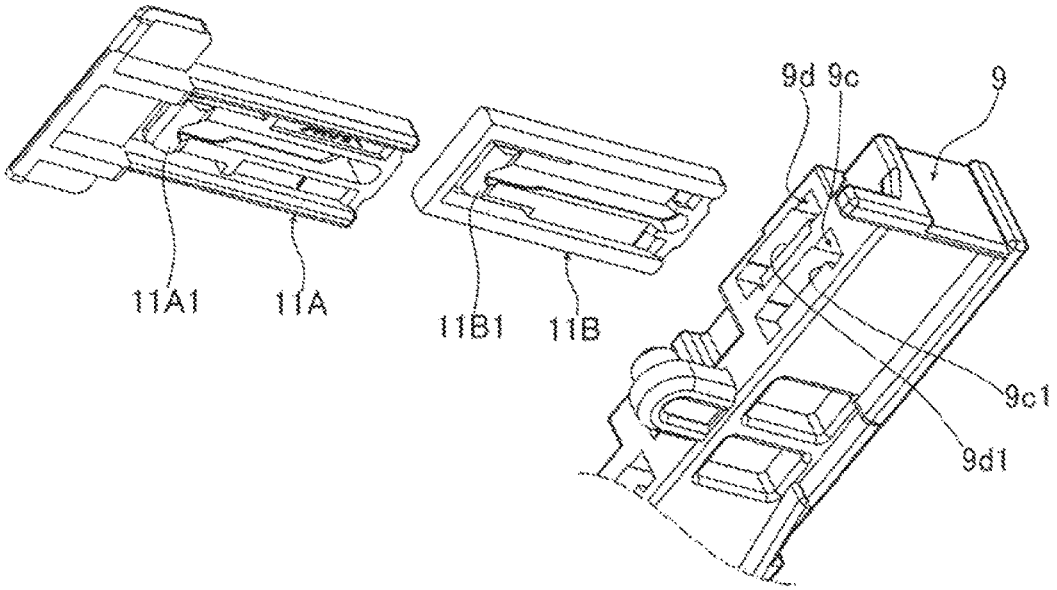
FIG. 7 is an enlarged perspective view showing a coupling structure between a change slide and a payout slide in the selectively-delivering section.

Now, a coupling structure between the payout link 9 and the payout cam 10 will be described with reference to FIG. 7. FIG. 7 is an enlarged perspective view showing the coupling structure between the payout link 9 and the payout cam 10 in the selectively-delivering section X. FIG. 7 shows the payout link 9 viewed from the lower front. A coupling projection 9*c*1, 9*d*1 is provided at a front end of each slide hole 9*c*, 9*d*, and a resiliently-swelled coupling projection 11A1,11B1 is provided in each of the first and second change slides 11*a*, 11B. In this way, the payout link 9 and the first and second change slides 11A, 11B are coupled with each other at a front end (a left side in FIG. 7) of the payout link 9 (loosely engaged with each other).

Although either of the first and second change slides 11A, 11B regulates the delivery of the coin, the way of the regulation is different from each other. Specifically, when an operation of the delivery of a coin is carried out, the first change slide 11A regulates the delivery of the coin C1 through the first payout slide 8A by supporting an underside of the coin. On the other hand, when an operation of the delivery of a coin is carried out, the second change slide 11B regulates the delivery of the coin C2 through the second payout slide 8B by regulating the movement of the second payout slide 8B.

The change lever 12 in the selectively-delivering section X is capable of adjusting its displacement to any one of three stages in height by controlling the energization to the solenoid 13 for the change lever. Specifically, in the standby mode or non-delivery state, the change lever 12 is adjusted to a height (namely, the lowest position) where the change lever 12 is abutted against rear ends of both of the first and second change slides 11A, 11B, while in the single-coin-delivery state, the change lever 12 is adjusted to a height (namely, an intermediate position) where the change lever 12 is abutted against only the end of the second change slide 11B, and in the double-coin-delivery state, the change lever 12 is adjusted to a height (namely, the highest position) where the change lever 12 is not abutted against any end of the first and second change slides 11A, 11B.

The movement of the second payout slide 8B is regulated along with the regulation of the motion of the second change slide 11B by the abutment of the change lever 12. Thus, the change lever 12 (i.e., the regulation operation member) is positioned at a first position (i.e., the intermediate position) to regulate the movement of the second payout slide 8B (the second delivering slide member) when the single coin should be delivered, whereas the change lever 12 is positioned at a second position (i.e., the highest position) not to regulate the movement of the second payout slide 8B (the second delivering slide member) when the at least two coins should be delivered. Specifically, at the first position (the intermediate position), the change lever 12 (the regulation operation member) regulates the movement of the second change slide 11B (the second delivery regulation member) without regulating the movement of the first change slide 11A (the first delivery regulation member) so that the second payout slide 8B (the second delivering slide member) is deactivated, on the other hand, at the second position (the highest position), the change lever 12 does not regulate the movements of the first and second change slides 11A, 11B (the first and second delivery regulation members) so that both of the first and second payout slides 8A, 8B (the first and second delivering slide members) are activated. Further, the change lever 12 (the regulation operation member) is configured to be positioned at a third position (i.e., the lowest position) to regulate the both movements of the first and second change slides 11A, 11B (the first and second delivery regulation members) when no coin should be delivered.

Further, the coupling structure between the coupling projection 9*c*1 of the payout link 9 and the coupling projection 11A1 of the first change slide 11A, and the coupling structure between the coupling projection 9*d*1 of the payout link 9 and the coupling projection 11B1 of the second change slide 11B are respectively function as a second coupling section that couples the first and second change slides 11A, 11B (the first and second delivery regulation members) to the payout link 9 (namely, the drive device) respectively. Namely, when the movement of the first and/or second change slides 11A, 11B (the first and/or second delivery regulation members) is regulated in response to the position of the change lever 12 (the regulation operation member), the coupling of the first and/or second change slides 11A, 11B (the first and/or second delivery regulation members) through the second coupling section is cancelled in accordance with the drive of the payout link 9 (the drive device) so that the first and/or second payout slides 8A, 8B (the first and/or second delivering slide members) are deactivated.

Figure 8A:
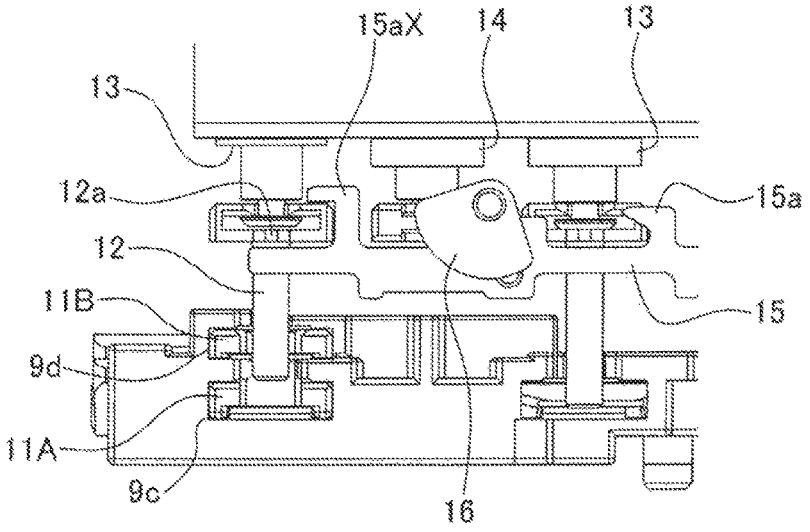
FIGS. 8A and 8B show diagrams for illustrating a way of positioning a change lever by means of a keeping lever.
Figure 8B:
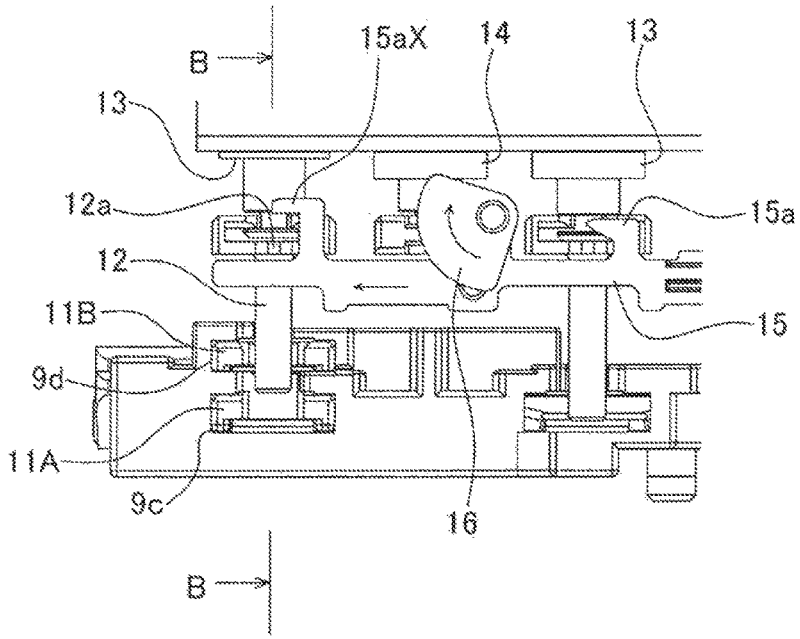
Figure 9A:
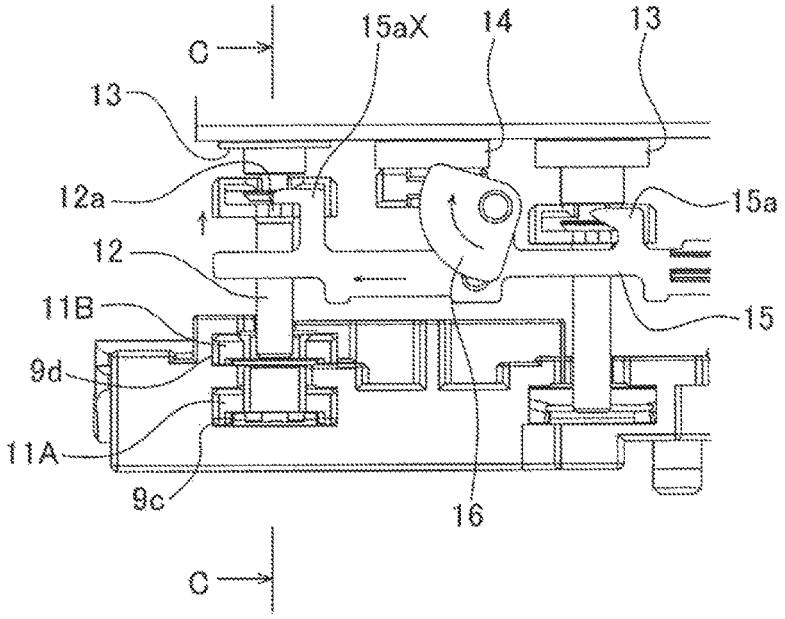
FIGS. 9A and 9B show diagrams for illustrating a way of positioning the change lever by means of the keeping lever.
Figure 9B:
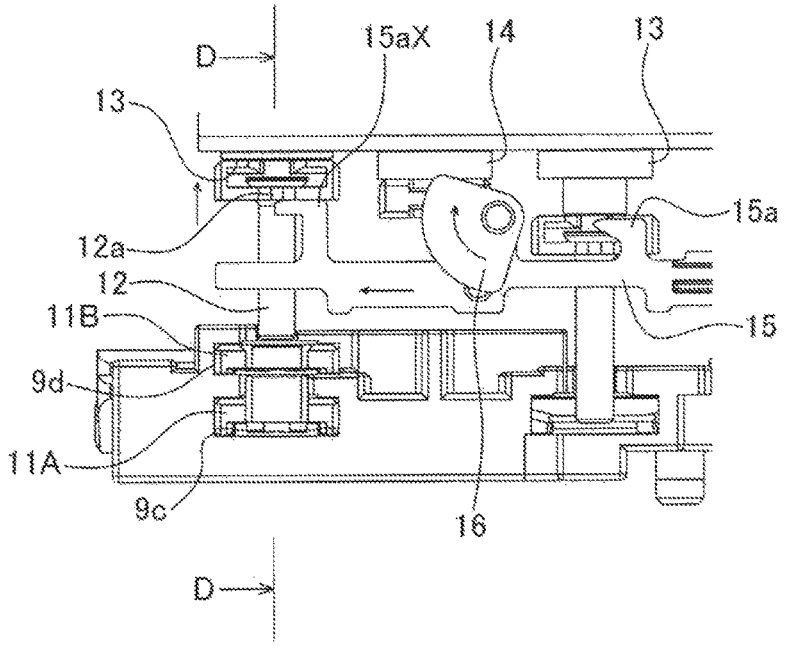

A specific way of adjusting the height of the change lever 12 will be described with reference to FIGS. 8 and 9. FIG. 8 shows diagrams for illustrating a way of positioning the change lever by means of the keeping lever, a part (a) is a view in the standby mode, and a part (b) is a view in the non-delivery state. FIG. 9 shows diagrams for illustrating a way of positioning the change lever by means of the keeping lever, a part (a) is a view in the single-coin-delivery state, and a part (b) is a view in the double-coin-delivery state. First, in the standby mode, neither the solenoid 13 for the change lever for operating the change lever 12 nor the solenoid 14 for the keeping lever for operating the keeping lever 15 is energized so that the change lever 12 is positioned at its initial position, i.e. the lowest end, and the keeping lever 15 is positioned at its initial position, i.e. the most right side in the figure (see FIG. 8(*a*)).

In the non-delivery state, the solenoid 13 for the change lever is not energized so that the change lever 12 is never operated to thereby keep its position to the initial lowest end. In this state, the solenoid 14 for the keeping lever may be energized, while the change lever 12 keeps its position to the lowest end (the lowest position) (see FIG. 8(*b*)).

In the single-coin-delivery state, at first, the solenoid 14 for the keeping lever is energized, then the keeping lever 15 moves leftward in the figure. Next, in response to energizing the solenoid 13 for the change lever, the change lever 12 is going to move upward. At this moment, because the keeping lever 15 has already moved the left side and the preventing segment 15*a*X is positioned above the keeping projection 12*a*, the preventing segment 15*a*X prevents an upward movement of the keeping projection 12*a*. In this way, although moving higher than the lowest position, namely the initial position, the change lever 12 keeps its position to a position (namely, the intermediate position) where the keeping lever 15 regulates the movement of the change lever 12 (see FIG. 9(*a*)).

In the double-coin-delivery state, at first, the solenoid 13 for the change lever is energized, then the change lever 12 moves to the most upper end. Next, in response to energizing the solenoid 14 for the keeping lever, the keeping lever 15 moves leftward in the figure. At this moment, because the keeping projection 12*a* of the change lever 12 has moved to a position higher than the preventing segment 15*a*X of the keeping lever 15, the preventing segment 15*a*X prevents a downward movement of the keeping projection 12*a* even if the energization to the solenoid 13 for the change lever is terminated. In this way, the change lever 12 keeps its position to the highest end (namely, the highest position) via the keeping lever 15 (see FIG. 9(*b*)).

Now, a description will be made about a coin-delivery operation of the selectively-delivering section X when the coin delivering device 3 according to the aforementioned arrangement is set to a delivery mode, with reference to FIGS. 10 to 12. Here, the "delivery mode" is a term opposite to the "standby mode" and refers to a mode where it is capable of delivering a coin from the payout slide 8 which is pulled out by a reaward movement of the payout link 9. Note that, in the delivery mode, the payout link 9 pulls out only the first payout slide 8A which is directly engaged with the payout link 9 through the projection 9*b* for engagement, but the second payout slide 8B also moves along with the first payout slide 8A unless regulated because the first and second payout slides 8A, 8B are roughly coupled with each other through the coupling projection 8A1 and the resiliently-swelled coupling projection 8B1 at the front ends thereof.

Figure 10A:
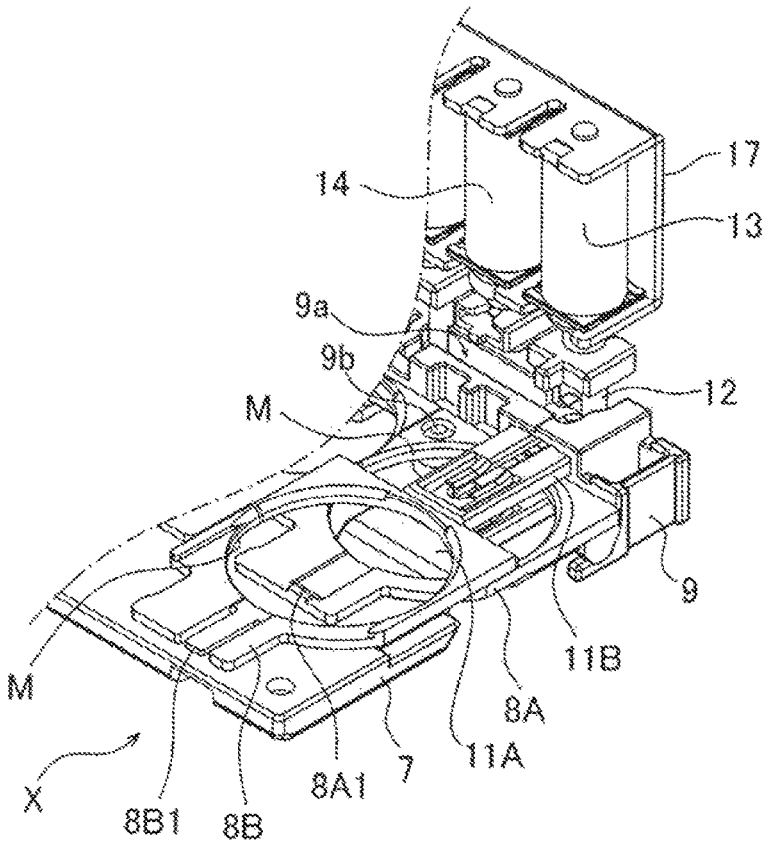
FIGS. 10A and 10B show diagrams for illustrating the non-delivery state of the coin delivering device.
Figure 10B:
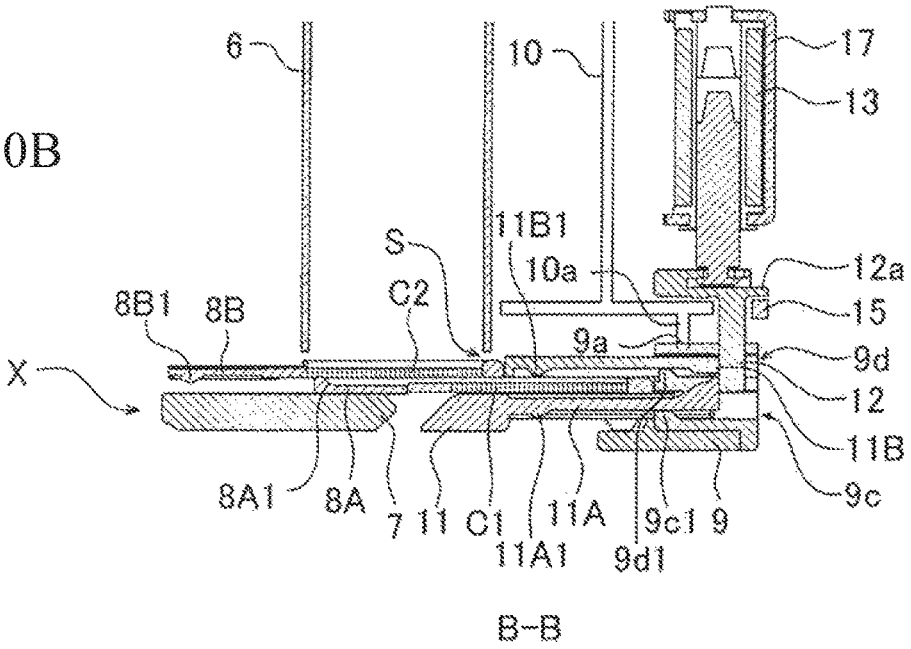

FIG. 10 shows diagrams for illustrating the non-delivery state of the coin delivering device 3, a part (a) is a perspective view of the selectively-delivering section X, and a part (b) is a sectional view along B-B line in FIG. 8(*b*). FIG. 11 shows diagrams for illustrating the single-coin-delivery state of the coin delivering device 3, a part (a) is a perspective view of the selectively-delivering section X, and a part (b) is a sectional view along C-C line in FIG. 9(*a*). FIG. 12 shows diagrams for illustrating the double-coin-delivery state of the coin delivering device 3, a part (a) is a perspective view of the selectively-delivering section X, and a part (b) is a sectional view along D-D line in FIG. 9(*b*). In order to illustrate a main portion, the coin tubes 6, the payout cam 10 and the coin C have been omitted in each part (a) of FIGS. 10 to 12.

In the non-delivery state, as shown in the parts (a) and (b) of FIG. 10, the height of the change lever 12 is set to a position (namely, the lowest position) where the change lever 12 abuts against both rear ends of the first and second change slides 11A, 11B. When the change lever 12 abuts against the first and second change slides 11A, 11B, neither of the first and second change slides 11A, 11B each being contacted with the corresponding one of the first and second payout slides 11A, 11B is allowed to move backward in the delivery mode.

In this case, because the coupling projection 11A1 of the first change slide 11A gets over the coupling projection 9*c*1 projected in the slide hole 9*c* of the payout link 9 when the payout link 9 moves backward, the coupling of the coupling projections 9*c*1 and 11A1 is cancelled. Thus, even if the payout link 9 moves backward, the first change slide 11A never moves backward. Similarly, because the coupling projection 11B1 of the second change slide 11B gets over the coupling projection 9*d*1 projected in the slide hole 9*d* of the payout link 9 when the payout link 9 moves backward, the coupling of the coupling projections 9*d*1 and 11B1 is cancelled. Thus, even if the payout link 9 moves backward, the second change slide 11B never moves backward.

In this case, as shown in FIG. 10(*b*), because there is the first change slide 11A under the coin C1 held in the first payout slide 8A, the coin C1 never falls down, and because there is the first payout slide 8A under the coin C2 held in the second payout slide 8B, the coin C2 never falls down. In this way, neither of coins C1 and C2 is delivered.

Figure 11A:
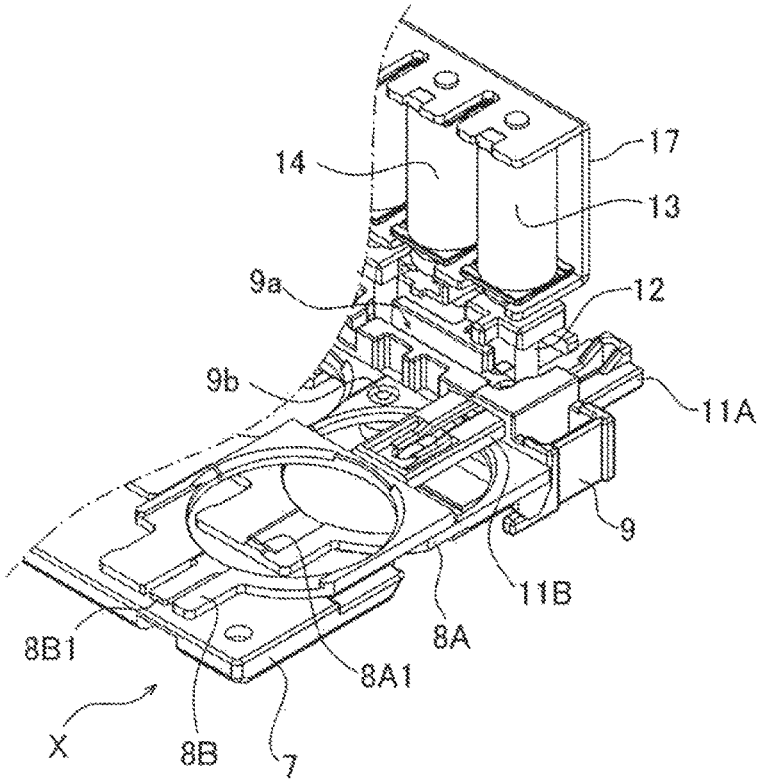
FIGS. 11A and 11B show diagrams for illustrating the single-coin-delivery state of the coin delivering device.
Figure 11B:
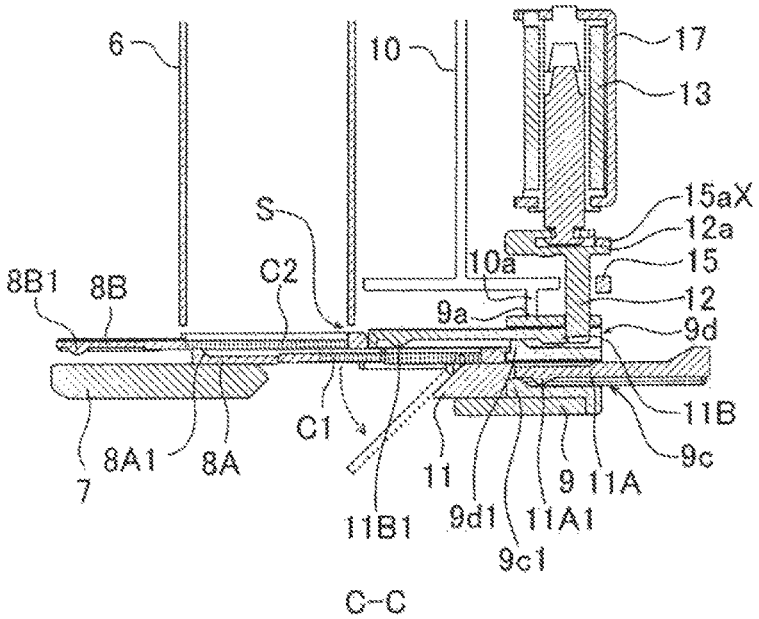

In the single-coin-delivery state, as shown in the parts (a) and (b) of FIG. 11, the height of the change lever 12 is set to a position (namely, the intermediate position) where the change lever 12 abuts against a rear end of only the second change slide 11B. When the change lever 12 abuts against only the second change slide 11B, the first change slide 11A is allowed to move backward in the delivery mode, but the second change slide 11B is not allowed to move backward.

In this case, because the coupling projection 11B1 of the second change slide 11B gets over the coupling projection 9*d*1 projected in the slide hole 9*d* of the payout link 9 when the payout link 9 moves backward, the coupling of the coupling projections 9*d*1 and 11B1 is cancelled. Thus, the second change slide 11B does not follow the movement of the payout link 9 and does not move backward. Further, because the coupling projection 8B1 of the second payout slide 8B gets over the coupling projection 8A1 provided on the first payout slide 8A when the first payout slide 8A moves backward along with the payout link 9, the coupling of the coupling projections 8A1 and 8B1 is cancelled too. Thus, the second payout slide 8B does not follow the movement of the first payout slide 8A and does not move backward.

In this case, as shown in FIG. 11(*b*), the coin C1 will fall down because there is not the first change slide 11A under the coin C1 held in the first payout slide 8A, but the coin C2 never falls down because there is the first payout slide 8A under the coin C2 held in the second payout slide 8B. In this way, only the single coin C1 is delivered.

Figure 12A:
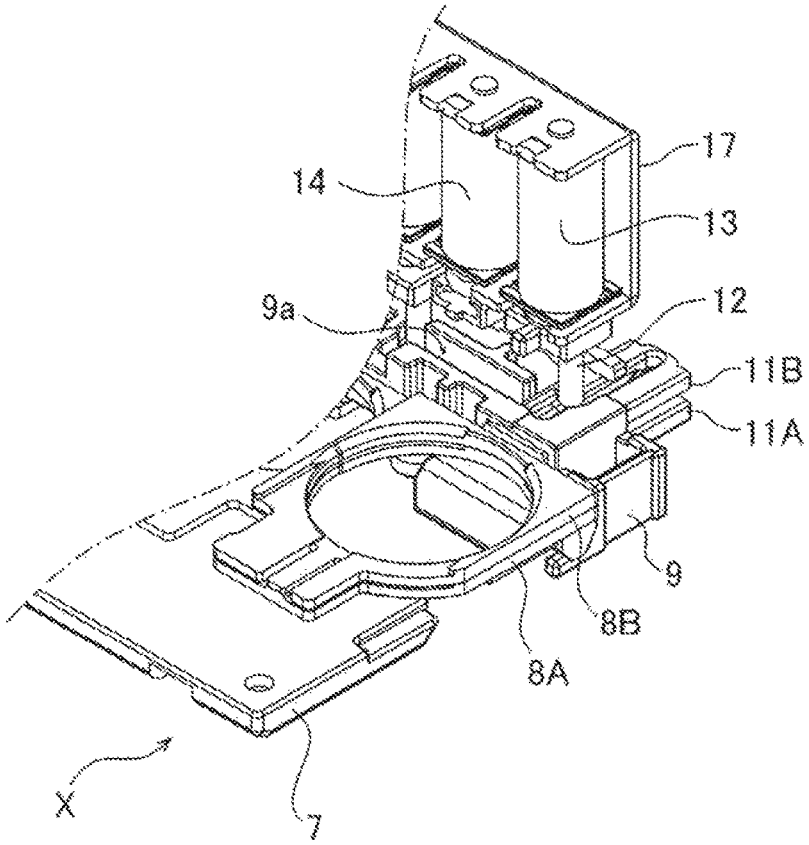
FIGS. 12A and 12B show diagrams for illustrating the double-coin-delivery state of the coin delivering device.
Figure 12B:
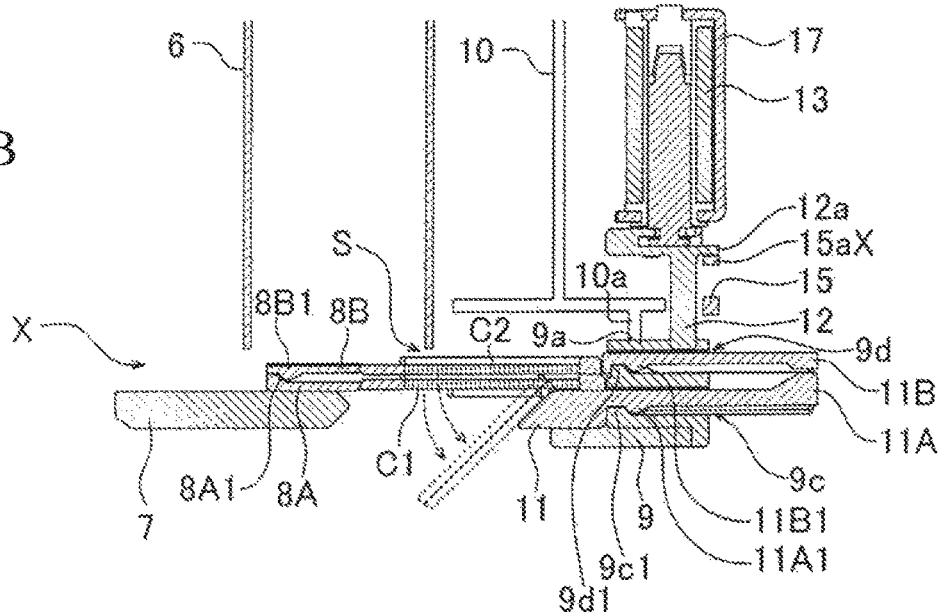

In the double-coin-delivery state, as shown in the parts (a) and (b) of FIG. 12, the height of the change lever 12 is set to a position (namely, the highest position) where the change lever 12 never abuts against any rear end of the first and second change slides 11A, 11B. Then, both of the first and second change slides 11A, 11B are allowed to move backward in the delivery mode. In this case, as shown in FIG. 12(*b*), the coin C1 will fall down because there is not the first change slide 11A under the coin C1 held in the first payout slide 8A, and the coin C2 will fall down too because there is not the first payout slide 8A under the coin C2 held in the second payout slide 8B. In this way, two coins C1 and C2 are delivered at a time.

A mechanism which includes the change lever 12, the solenoid 13, etc. as mentioned above functions as a selection mechanism that performs a selection such that the first payout slide 8A (namely, the first delivering slide member) is activated alone or the first and second payout slides 8A, 8B (namely, the first and second delivering slide members) are activated together. Namely, a single coin is delivered through the first payout slide 8A (namely, the first delivering slide member) having been activated alone, on the other hand, two coins are delivered through the first and second payout slides 8A, 8B (namely, the first and second delivering slide members) having been activated together (it should be noted that it is possible to deliver three or more coins at a time as described later).

According to the coin delivering device 3 of the embodiment as mentioned above, the first and second payout slides 8A, 8B are disposed up and down as the payout slide 8, the first and second change slides 11A, 11B are disposed adjacent to the payout slide 8, and the positioning of the change lever 12 is determined in such a manner as to how many numbers of the first and second change slides 11A, 11B should be abutted against the change lever 12. In this way, each of the first and second change slides 11A, 11B regulates the slide movement of the corresponding one of the first and second payout slides 8A, 8B and determines the number of coins to be delivered. Thus, the number of coins to be delivered from the single coin tube 6 can be selectively determined.

It should be noted that the aforementioned coin delivering device 3 may be configured so that the first payout slide 8A and the second payout slide 8B are engageable with each other. With such a configuration, by the drive of the payout link 9 for pulling out only the first payout slide 8A, the second payout slide 8B can be pulled out too unless regulated by the other members such as the first and/or second change slides 11A, 11B, so that the payout slide 8 can be efficiently pulled out.

Further, the aforementioned coin delivering device 3 may be configured so that the first change slide 11A and the second change slide 11B are engageable with the payout link 9. With such a configuration, by pulling out only the payout link 9, the first and second change slides 11A, 11B can be pulled out too unless regulated by the other member such as the change lever 12, so that the first and second change slides 11A, 11B can be efficiently pulled out.

According to the aforementioned coin delivering device 3, the keeping lever 15 is provided to prevent the movement of the change lever 12, and the keeping lever 15 is operated prior to an operation of the change lever 12 so that an upward movement of the change lever 12 is prevented when a single coin C should be delivered, whereas the keeping lever 15 is operated after an operation of the change lever 12 so that an downward movement of the change lever 12 is prevented when two coins C should be delivered. In this way, the position of the change lever 12 can be defined step-by-step by only determining which of the change lever 12 and the keeping lever 15 should be operated prior to another one.

Further, according to the aforementioned coin delivering device 3, a way of regulating the delivery of the coin C1 at the bottom through the first change slide 11A is differentiated from a way of regulating the delivery of the coin C2 located in the second from the bottom through the second change slide 11B. Namely, a simply way of regulation is employed such that only the first change slide 11A is employed in supporting the underside of the coin and the second change slide 11B is employed in only regulating the movement of the second payout slide 8B. In this way, there is no space required between the first and second change slides 11A, 11B and/or between the first and second payout slides 8A, 8B. Thus, the selectively-delivering section X and the coin delivering device 3 can be constructed compactly.

According to a modification of the aforementioned embodiment, the second change slide 11B (namely, the second delivery regulation member) can be omitted, the second payout slide 8B (namely, the second delivering slide member) may be directly regulated by the change layer 12 instead. For example, the second payout slide 8B and the second change slide 11B as shown in the figure may be integrally formed as a modified second payout slide 8B having an elongated length capable of abutting against the change layer 12. Alternatively, while the modified second payout slide 8B has a length similar to as shown in the figure, the shape of the change lever 12 may be modified such that a portion of the change lever 12 can be abutted against the second payout slide 8B (namely, the second delivering slide member).

Although the one embodiment of the present invention has been described above, the coin processing device according to the present invention is not limited to the aforementioned embodiment, and various modifications can be realized within the scope of the technical ideas and/or concepts described in the claims, description and drawings attached hereto. For example, because the aforementioned embodiment employs such a regulation way that the second change slide 11B regulates the movement of the second payout slide 8B and the coin is supported by the payout slide 8 located under the coin, a plurality sets of the combination of the second payout slide 8B and the second change slide 11B may be provided in a superimposed manner. For example, a combination of the third (or more) payout slide 8 and change slide 11 having a construction similar to the combination of the second payout slide 8B and the second change slide 11B may be disposed above the second change slide 11B so that any number of coins selected from among one to three or more can be delivered.

In an alternative embodiment, a single combination of the second payout slide 8B and the second change slide 11B may be configured to deliver not only one coin but also two or more coins at a time (namely, the thickness of the second payout slide 8B may be formed in a thickness capable of delivering two or more predetermined number of coins at a time). For example, in a case where the single combination of the second payout slide 8B and the second change slide 11B is configured to deliver two coins at a time, three coins can be delivered at a time when the first and second payout slides 8A, 8B are simultaneously activated.

Further, the selection mechanism for selectively activating the first and second payout slides 8A, 8B is not limited to the construction as shown in the aforementioned embodiment, and may be a construction capable of selecting a mode for delivering a single coin by activating only the first payout slide 8A (namely, the first delivering slide member) or a mode for delivering at least two coins by activating both of the first and second payout slides 8A, 8B (namely, the first and second delivering slide members). For example, because the first and second change slides 11A, 11B function so as to select (or allow) any one or more coin tubes 6 to deliver a coin or coins in such a basic construction that the payout slides 8 of the plurality of coin tubes 6 are commonly driven by means of a common drive device (namely, the payout link 9, the payout cam 10, etc.), in a case where such a basic construction is not employed in the coin delivering device 3, the first and second change slides 11A, 11B may be omitted as necessary. For example, in a case where a separate drive device for coin delivery is employed for each of the coin tubes 6, or in a case where the coin delivering device 3 comprises only one coin tube 6, these first and second change slides 11A, 11B (namely, the first and second delivery regulation members) may be omitted.

What is claimed is:

1. A coin delivering device comprising:

a coin storage section configured to store coins and having a slit for delivering a coin at a lower end of the coin storage section;

a first delivering slide member for delivering a coin located at a bottom in the coin storage section;

a second delivering slide member for delivering at least one coin located on the coin at the bottom in the coin storage section; and a selection mechanism that performs a selection such that the first delivering slide member is activated alone or the first and second delivering slide members are activated together, wherein a single coin is delivered through the first delivering slide member having been activated alone, whereas at least two coins are delivered through the first and second delivering slide members having been activated together, wherein the selection mechanism includes a regulation operation member that is selectively displacable, the regulation operation member being positioned at a first position to regulate a movement of the second delivering slide member when the single coin should be delivered, the regulation operation member being positioned at a second position not to regulate the movement of the second delivering slide member when the at least two coins should be delivered.

2. The coin delivering device as claimed in claim 1, which further comprises:

a drive device that drives the first delivering slide member in order to deliver a coin; and a first coupling section that couples the second delivering slide member to the first delivering slide members, and wherein when the movement of the second delivering slide member is not regulated, the second delivering slide member moves along with the first delivering slide member through the first coupling section as the first delivering slide member is driven by the drive device, whereas when the movement of the second delivering slide member is regulated, the coupling of the first and second delivering slide members through the first coupling section is cancelled as the first delivering slide member is driven by the drive device so that the second delivering slide member is deactivated.

3. The coin delivering device as claimed in claim 2, which further comprises:

a first delivery regulation member disposed adjacently to the first delivering slide member in a direction of a movement for delivering a coin, and configured to regulate a delivery of a coin through the first delivering slide member; and a second delivery regulation member disposed adjacently to the second delivering slide member in a direction of a movement for delivering a coin, and configured to regulate a delivery of a coin through the second delivering slide member, wherein, at the first position, the regulation operation member regulates a movement of the second delivery regulation member without regulating a movement of the first delivery regulation member so that the second delivering slide member is deactivated, on the other hand, at the second position, the regulation operation member does not regulate the movements of the first and second delivery regulation members so that both of the first and second delivering slide members are activated, and wherein the regulation operation member is further configured to be positioned at a third position to regulate the both movements of the first and second delivery regulation members when no coin should be delivered.

4. The coin delivering device as claimed in claim 3, which further comprises a second coupling section that couples the first and second delivery regulation members to the drive device respectively, and wherein when the movement of the first and/or second delivery regulation members is regulated in response to the position of the regulation operation member, the coupling of the first and/or second delivery regulation members through the second coupling section is cancelled in accordance with a drive of the drive device so that the first and/or second delivering slide members are deactivated.

5. The coin delivering device as claimed in claim 3, wherein when an operation of the delivery of a coin is carried out, the first delivery regulation member supports an underside of the coin so that the delivery of the coin through the first delivering slide member is regulated, and wherein when an operation of the delivery of a coin is carried out, the second delivery regulation member regulates the movement of the second delivering slide member so that the delivery of the coin through the second delivering slide member is regulated.

6. The coin delivering device as claimed in claim 1, further comprising a movement preventing member that prevents a movement of the regulation operation member, wherein, when the single coin is delivered, the movement preventing member is operated prior to an operation of the regulation operation member so that an upward movement of the regulation operation member is prevented, and wherein, when the at least two coins are delivered, the movement preventing member is operated after an operation of the regulation operation member so that an downward movement of the regulation operation member is prevented.

7. The coin delivering device as claimed in claim 1, wherein a plurality of the second delivering slide members are provided in an overlapped arrangement, and wherein the selection mechanism is further configured to selectively activate any of the plurality of the second delivering slide members.

8. The coin delivering device as claimed in claim 1, which further comprises:

a first delivery regulation member disposed adjacently to the first delivering slide member in a direction of a movement for delivering a coin, and configured to regulate a delivery of a coin through the first delivering slide member; and a second delivery regulation member disposed adjacently to the second delivering slide member in a direction of a movement for delivering a coin, and configured to regulate a delivery of a coin through the second delivering slide member, wherein, at the first position, the regulation operation member regulates a movement of the second delivery regulation member without regulating a movement of the first delivery regulation member so that the second delivering slide member is deactivated, on the other hand, at the second position, the regulation operation member does not regulate the movements of the first and second delivery regulation members so that both of the first and second delivering slide members are activated, and wherein the regulation operation member is further configured to be positioned at a third position to regulate the both movements of the first and second delivery regulation members when no coin should be delivered.

9. The coin delivering device as claimed in claim 8, wherein when an operation of the delivery of a coin is carried out, the first delivery regulation member supports an underside of the coin so that the delivery of the coin through the first delivering slide member is regulated, and wherein when an operation of the delivery of a coin is carried out, the second delivery regulation member regulates the movement of the second delivering slide member so that the delivery of the coin through the second delivering slide member is regulated.

10. A coin delivering device comprising:

a coin storage section configured to store coins and having a slit for delivering a coin at a lower end of the coin storage section;

a first delivering slide member for delivering a coin located at a bottom in the coin storage section;

a second delivering slide member for delivering at least one coin located on the coin at the bottom in the coin storage section;

a selection mechanism that performs a selection such that the first delivering slide member is activated alone or the first and second delivering slide members are activated together, wherein a single coin is delivered through the first delivering slide member having been activated alone, whereas at least two coins are delivered through the first and second delivering slide members having been activated together; and a delivery regulation member that selectively regulates a delivery of a coin from the coin storage section, and wherein, in a condition that a delivery of a coin from the coin storage section is regulated by the delivery regulation member, the delivery of a coin from the coin storage section is not realized in spite of an activation of the first delivering slide member.

* * * * *